US005741999A

United States Patent [19]

Kazumi et al.

[11] Patent Number: 5,741,999

[45] Date of Patent: Apr. 21, 1998

[54] GAS GENERATING AGENT COMPOSITION

[76] Inventors: Takashi Kazumi; Takeshi Okada, both of 2-1 Dobu, Nagasaka Aza, Oaza, Nishigo-mura, Nishishirakawa-gun, Fukushima-ken, Japan

[21] Appl. No.: 494,414

[22] Filed: Jun. 26, 1995

[51] Int. Cl.[6] ..... C06B 35/00

[52] U.S. Cl. ..... 149/35; 149/42; 149/43; 149/61; 149/77; 149/19.1; 149/19.3

[58] Field of Search ..... 149/35, 42, 43, 149/61, 77; 252/187.31, 186.44, 4, 5, 6

[56] References Cited

U.S. PATENT DOCUMENTS

| | | | |
|---|---|---|---|
| 3,613,758 | 10/1971 | Gawlick et al. | 149/15 |
| 3,890,168 | 6/1975 | Shumway | 149/37 |
| 3,904,221 | 9/1975 | Shiki et al. | 280/736 |
| 3,920,575 | 11/1975 | Shiki et al. | 149/35 |
| 3,947,300 | 3/1976 | Passauer et al. | 149/35 |
| 4,080,227 | 3/1978 | Hartzel et al. | 149/22 |
| 4,247,494 | 1/1981 | Carter | 149/24 |
| 4,696,705 | 9/1987 | Hamilton et al. | 149/21 |
| 4,836,255 | 6/1989 | Schneiter et al. | 149/35 |
| 5,417,160 | 5/1995 | Mei et al. | 102/289 |

FOREIGN PATENT DOCUMENTS

| | | |
|---|---|---|
| 63-242987 | 11/1962 | Japan . |
| 58-20920 | 5/1973 | Japan . |
| 5-155307 | 12/1991 | Japan . |
| 5-23887 | 10/1992 | Japan . |

*Primary Examiner*—Sharon Gibson
*Assistant Examiner*—Joseph D. Anthony

[57] ABSTRACT

This invention aims to provide a gas generating composition of a gas generator for an air bag, which composition produces less combustion residues and is easily adsorbed. This composition comprises azide of alkali metal or alkaline earth metal, metallic silicide, and perchlorate or nitrate of alkali metal or alkaline earth metal. The combustion residues of the azide are changed to be glass silicate by the metallic silicide and caught by a filter of the gas generator, so that they do not pass through the filter of the gas generator nor make holes in the air bag unlike a conventional gas generator. And, the addition of silicon dioxide further improves the catching of the combustion residues of the azide.

8 Claims, 1 Drawing Sheet

GAS GENERATING AGENT COMPOSITION

BACKGROUND OF THE INVENTION

1. Field of the Invention

This invention relates to a gas generating agent composition of a gas generator for an air bag which is a safety device installed in a vehicle such as automobiles to protect an occupant in case of a collision.

2. Related Art

For an azide-based gas generating agent composition, various metallic oxides have been used as disclosed in, for example, Japanese Patent Publication No. 58-20920, Japanese Patent Application Laid-open Prints No. 63-242987 and No. 5-238867.

Such a gas generating agent composition is disposed in a gas generator which has a filter to catch combustion residues. Such a gas generator is provided with an air bag which is instantaneously inflated by nitrogen gas generated when the gas generating agent composition burns.

The metallic oxides contained in the gas generating agent composition, however, are produced as combustion residues after releasing oxygen when the gas generating agent composition is quickly burned, some of the combustion residues pass through the filter of the gas generator to enter the air bag, thus they have side effects, e.g., making holes in the air bag.

SUMMARY OF THE INVENTION

This invention has been completed to remedy such existing drawbacks, and aims to provide a gas generating composition with less combustion residues and a gas generating composition whose combustion residues can be readily adsorbed.

A gas generating composition according to this invention comprises azide of alkali metal or alkaline earth metal, metallic silicide, and perchlorate or nitrate of alkali metal or alkaline earth metal.

And, a gas generating composition according to this invention comprises azide of alkali metal or alkaline earth metal, metallic silicide, perchlorate or nitrate of alkali metal or alkaline earth metal, and silicon dioxide.

The gas generating composition according to this invention contains 50 to 70% by weight of azide of alkali metal or alkaline earth metal, 20 to 40% by weight of metallic silicide, and 1 to 15% by weight of perchlorate or nitrate of alkali metal or alkaline earth metal.

The gas generating composition according to this invention contains 50 to 70% by weight of azide of alkali metal or alkaline earth metal, 20 to 40% by weight of metallic silicide, 1 to 15% by weight of perchlorate or nitrate of alkali metal or alkaline earth metal, and 1 to 10% by weight of silicon dioxide.

In the gas generating composition according to this invention, the metallic silicide is molybdenum silicide, tungsten silicide, titanium silicide, zirconum silicide, niobium silicide, or tantalum silicide.

In this invention, the alkali metal means lithium, sodium, potassium, rubidium, cesium, and francium which belong to group IA of the periodic table. Among them, sodium and potassium are suitable for the object of this invention. The other substances are also known to exist, but it is not known whether they can be produced, and they are not popular. Besides, they have disadvantages in view of a cost and safety.

The azide of alkali metal or alkaline earth metal shall be used in 50 to 70% by weight to attain a gas temperature which does not damage an air bag and others, and not to produce harmful sodium metal or the like solely.

The same is applied to the perchlorate. If it is used in a large amount, the gas generating agent burns at a high temperature, causing a bad effect that the chamber in the gas generator after combustion has a high temperature. Therefore, it shall be 1 to 15% by weight, more preferably 3 to 8% by weight.

The perchlorate is potassium perchlorate, sodium perchlorate, magnesium perchlorate, calcium perchlorate, strontium perchlorate, cesium perchlorate, cerium perchlorate, or barium perchlorate. Among them, potassium perchlorate is suitable for the object of this invention. The other substances are also known to exist, but it is not known whether they can be produced, and they are not popular. Besides, they have disadvantages in view of a cost and safety.

The metallic silicide has a reducing action, and if used in a large amount, ignition cannot be made easily. And, even if ignited, combustion may be stopped without burning completely. Therefore, it shall be used in 20 to 40% by weight.

The metallic silicide indicates those expressed by $MSi_2$, and includes calcium silicide, strontium silicide, barium silicide, cerium silicide, titanium silicide, zirconium silicide, thorium silicide, vanadium silicide, niobium silicide, tantalum silicide, chromium silicide, molybdenum silicide, tungsten silicide, uranium silicide, plutonium silicide, manganese silicide, rhenium silicide, iron silicide, cobalt silicide, and nickel silicide. Among them, molybdenum silicide, tungsten silicide, titanium silicide, zirconlure silicide, niobium silicide, or tantalum silicide is suitable for the object of this invention.

When the silicon dioxide is used in a large amount, its effect of adsorbing sodium metal and others can be expected, but moldability becomes poor when its amount exceeds 10% by weight. Therefore, it shall be used in 1 to 10% by weight.

In this invention, the combustion reaction of the azide of alkali metal or alkaline earth metal is an oxidation-reduction reaction, and the volume of oxygen supplied has a large effect on the combustion. Therefore, the same volume of oxygen delivers the same performance. Nitrate has the same performance as perchlorate.

Perchlorate contains 0.46 of oxygen in one gram thereof, and has a sufficient ability to oxidize alkali metal or alkaline earth metal solely which is produced when the azide of alkali metal or alkaline earth metal is decomposed.

Nitrate also contains 0.40 of oxygen in one gram thereof, and has almost the same volume of oxygen as perchlorate. Therefore, it has an ability to oxidize unreacted atoms to produce stable solids.

The nitrate includes sodium nitrate, potassium nitrate, magnesium nitrate, calcium nitrate, strontium nitrate, cesium nitrate, cerium nitrate, barium nitrate, bismuth nitrate and others. Among them, potassium nitrate is preferable for the object of this invention. Potassium nitrate is not hygroscopic, and is readily usable and preferable in view of a cost.

This invention can use a binder to make a desired shape, e.g., a pellet or a disk. The binder is prepared by solving fluoro-rubber, cellulose, isoprene rubber, butadiene rubber, butyl rubber, acrylic rubber, urethane rubber or silicon rubber with a solvent such as acetone, toluene, xylene, cyclohexane, butyl acetate or alcohol.

In a reaction when the azide of alkali metal or alkaline earth metal burns in this invention; namely when sodium azide burns, $Na_2O$ which is produced when $NaN_3$ is oxidized reacts wit, h $SiO_2$ which is produced when metallic silicide is oxidized; glass silicate ($Na_2O.SiO_2$) which is easily adsorbed to the filter is formed.

The metallic silicide can exert a catalytic reaction without melting within the gas generator. Namely, the metallic silicide has a high melting point, so that combustion residues are caught in the form of molten metal oxides by the filter to remain within the gas generator, and do not get out of the gas generator.

In other words, the combustion residues of the azide are changed to be glass silicate by the metallic silicide and caught by the filter of the gas generator, so that they do not pass through the filter of the gas generator nor make holes in the air bag unlike a conventional gas generator.

Generally used metal oxides (e.g., triiron tetroxide) tend to decrease the combustion speed of a gas generating agent composition, while the metallic silicide has an effect to increase the combustion speed.

Alkali metal and alkaline earth metal have characteristics that the electron configuration in an ionic state is easy to become + ions.

And, silicon dioxide has a gap in binding of oxygen atoms between silicon atoms, and this gap appears as – ions.

Therefore, alkali metal and alkaline earth metal are atoms which are ionically bonded easily when reacted with silicon dioxide.

Thus, alkali metal and alkaline earth metal benefit from the residue reducing effect owing to metallic silicide.

As a result, the addition of silicon dioxide further improves the catching of the combustion residues of the azide.

BRIEF DESCRIPTION OF THE PREFERRED EMBODIMENTS

Example 1

Figure 1:
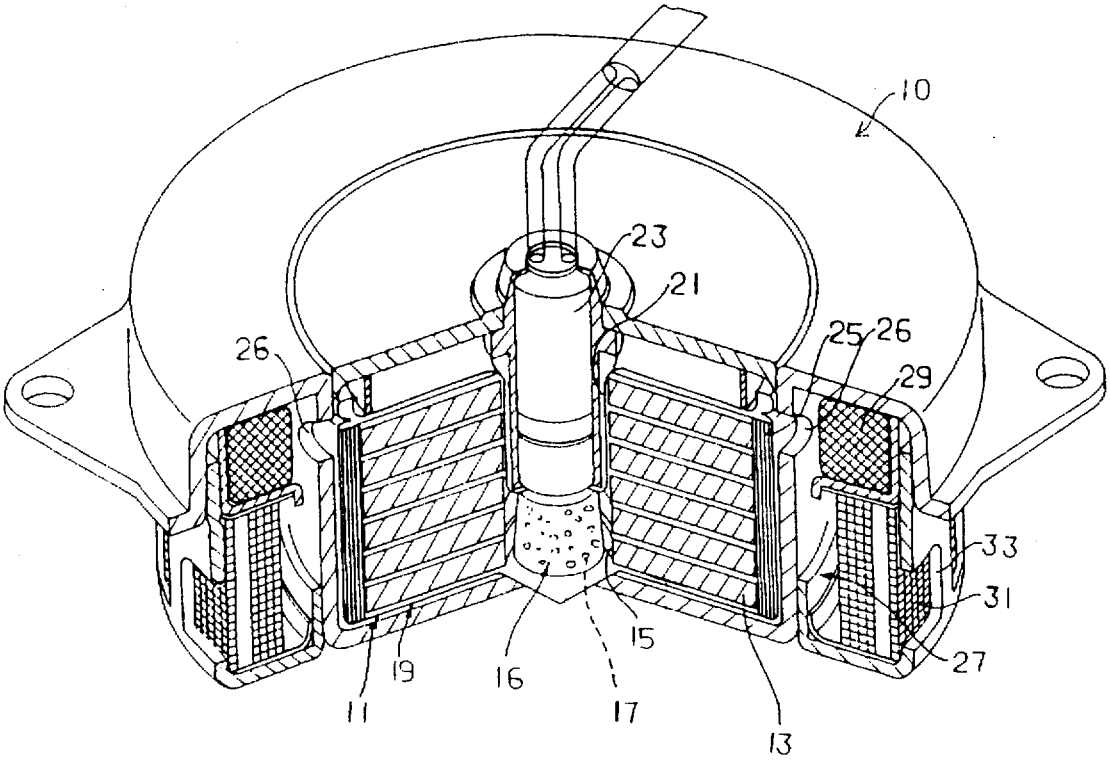
FIG. 1 is a perspective view of the gas generator with essential parts broken away which is used in examples and a comparative example of this invention.

Into a mixing machine, 58% by weight of sized sodium azide, 28% by weight of molybdenum silicide, 6% by weight of potassium perchlorate, and 6% by weight of silicon dioxide were charged and mixed in dry condition.

To the obtained mixture, 2% by weight of fluoro rubber solved with acetone was charged, and they were mixed in wet condition.

The prepared moist gas generating agent was passed though a sieve to obtain granules with a particle diameter of 0.8 mm.

This granular gas generating agent was dried in a dryer and molded into the shape of disks.

The disk-type gas generating agent in a total weight of 60 g was placed in a gas generator 10 as shown in FIG. 1.

This gas generator 10 is the air bag inflating gas generator disclosed in Japanese Patent Application Laid-open Prints No. 5-1553071 by the same applicant.

This gas generator 10 contains a plenum chamber 27 and a combustion chamber 11 having a capacity of 82 $cm^3$, which accommodates a plurality of disk-type gas generating agents 13 each having a diameter of 53 mm and a thickness of 5 mm.

The gas generating agent 13 has a through hole 15 with a diameter of 14 mm at the center, and the through hole 15 accommodates an enclosed container 16 which contains an ignition agent 17.

The above members are placed in a concealed container 19, at the center of which a concave part 21 is formed to sink into the through hole 15 of the gas generating agents 13. This concave part 21 contains an igniter 23 for burning the gas generating agents 13.

A combustion chamber filter 25 is disposed along the inner wall of the combustion chamber 11, and the plenum chamber 27 is annularly disposed around the combustion chamber 11. Into the plenum chamber 27, gas flows through orifices 26 after passing through the combustion chamber filter 25.

The plenum chamber 27 has a plenum chamber filter which consists of an upper filter 29 and a gas filter 31.

The plenum chamber 27 is provided with gas outlets 33 for letting out the gas, which has passed through the gas filter 31, into an air bag.

The gas generator 10 having the above structure was positioned in a 60-liter tank. When an electric current was passed to the igniter 23, powder in the igniter 23 was burned, the enclosed container 16 was burned, the wall of the enclosed container 16 in contact with the igniter 23 was broken to prime the ignition agent 17, and the ignition agent 17 was burned. Then, the gas generating agents 13 were burned, gas produced from the gas generating agents 13 passed though the combustion chamber filter 25 which was disposed along the inner wall of the combustion chamber 11 to enter the plenum chamber 27, the gas was cleaned by the upper filter 29 and the gas filter 31, and went out through the gas outlets 33. A combustion speed was 29.1 mm/sec (under a condition of 1 MPa).

Then, the tank was washed with 1 liter of water, this water was evaporated to dryness, and residues were weighed. The residue weight was 3.3 g.

Example 2

Into a mixing machine, 58% by weight of sized sodium azide, 28% by weight of molybdenum silicide, 3% by weight of potassium perchlorate, and 9% by weight of silicon dioxide were charged and mixed in dry condition.

To the obtained mixture, 2% by weight of fluoro rubber solved with acetone was charged, and they were mixed in wet condition.

The prepared moist gas generating agent was passed though a sieve to obtain granules with a particle diameter of 0.8 mm.

This granular gas generating agent was dried in a dryer and molded in the shape of disks.

The prepared disk-type gas generating agents were burned in the same way as in Example 1. A combustion speed and a residue weight were measured.

The combustion speed was 22.2 mm/sec, and the residue weight was 1.4 g.

Comparative Example

Into a mixing machine, 62% by weight of sized sodium azide, 30.5% by weight of triiron tetroxide ($Fe_3O_4$), and 3% by weight of potassium perchlorate were charged and mixed in dry condition.

To the obtained mixture, 2.5% by weight of fluoro rubber solved with acetone was charged, and they were mixed in wet condition.

The prepared moist gas generating agent was passed though a sieve to obtain granules with a particle diameter of 0.8 mm.

This granular gas generating agent was dried in a dryer and molded in the shape of disks.

The prepared disk-type gas generating agents were burned in the same way as in Example 1. A combustion speed and a residue weight were measured.

The combustion speed was 27.0 mm/sec, and the residue weight was 10.0 g.

Comparison

The combustion speeds and the residue weights in Examples 1 and 2 and Comparative Example will be described.

The gas generating agents of Example 1 had a combustion speed faster as compared with those of Comparative Example, and their residue amount was about ⅓ of that of the gas generating agents of Comparative Example even when their combustion temperature was higher.

The gas generating agents of Example 2 had a slightly slower combustion speed as compared with the gas generating agents of Comparative Example, but the residue amount was about 1/10 of that of the gas generating agents of Comparative Example.

What is claimed is:

1. A gas generating agent composition comprising 50 to 70% by weight of azide of alkali metal or alkaline earth metal, 20 to 40% by weight of metallic silicide, and 1 to 15% by weight of perchlorate of alkali metal or alkaline earth metal.

2. A gas generating agent composition according to claim 1, wherein the metallic silicide is molybdenum silicide, tungsten silicide, titanium silicide, zirconium silicide, niobium silicide, or tantalum silicide.

3. A gas generating agent composition comprising 50 to 70% by weight of azide of alkali metal or alkaline earth metal, 20 to 40% by weight of metallic silicide, and 1 to 15% by weight of nitrate of alkali metal or alkaline earth metal.

4. A gas generating agent composition according to claim 3, wherein the metallic silicide is molybdenum silicide, tungsten silicide, titanium silicide, zirconium silicide, noibium silicide, or tantalum silicide.

5. A gas generating agent composition comprising 50 to 70% by weight of azide of alkali metal or alkaline earth metal, 20 to 40% by weight of metallic silicide, 1 to 15% by weight of perchlorate of alkali metal or alkaline earth metal, and 1 to 10% by weight of silicon dioxide.

6. A gas generating agent composition according to claim 5, wherein the metallic silicide is molybdenum silicide, tungsten silicide, titanium silicide, zirconium silicide, noibium silicide, or tantalum silicide.

7. A gas generating agent composition comprising 50 to 70% by weight of azide of alkali metal or alkaline earth metal, 20 to 40% by weight of metallic silicide, 1 to 15% by weight of nitrate of alkali metal or alkaline earth metal, and 1 to 10% by weight of silicon dioxide.

8. A gas generating agent composition according to claim 7, wherein the metallic silicide is molybdenum silicide, tungsten silicide, titanium silicide, zirconium silicide, noibium silicide, or tantalum silicide.

* * * * *